US011859880B2

(12) United States Patent
Pickle et al.

(10) Patent No.: US 11,859,880 B2
(45) Date of Patent: Jan. 2, 2024

(54) REHEAT OPERATION FOR HEAT PUMP SYSTEM

(71) Applicant: Johnson Controls Technology Company, Auburn Hills, MI (US)

(72) Inventors: Stephen Blake Pickle, Norman, OK (US); Kerry Lyman Shumway, Norman, OK (US); Thinh Huy Nguyen, Oklahoma City, OK (US); Bradford Graham Briley, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 252 days.

(21) Appl. No.: 17/344,678

(22) Filed: Jun. 10, 2021

(65) Prior Publication Data

US 2022/0397314 A1 Dec. 15, 2022

(51) Int. Cl.

| | |
|---|---|
| ***F25B 30/02*** | (2006.01) |
| ***F25B 41/20*** | (2021.01) |
| ***F25B 41/26*** | (2021.01) |
| ***F25B 29/00*** | (2006.01) |

(52) U.S. Cl.

CPC ..... *F25B 30/02* (2013.01); *F25B 29/003* (2013.01); *F25B 41/20* (2021.01); *F25B 41/26* (2021.01); *F25B 2300/00* (2013.01); *F25B 2313/0292* (2013.01)

(58) Field of Classification Search

CPC ..... F25B 49/02; F25B 2313/0253; F25B 2313/0292; F25B 2300/00; F25B 41/26; F25B 41/20; F25B 29/003; F25B 30/02

See application file for complete search history.

(56) References Cited

U.S. PATENT DOCUMENTS

| | | | | |
|---|---|---|---|---|
| 6,381,970 | B1 | 5/2002 | Eber et al. | |
| 7,275,384 | B2 | 10/2007 | Taras et al. | |
| 7,980,087 | B2 | 7/2011 | Anderson et al. | |
| 8,397,522 | B2 | 3/2013 | Springer et al. | |
| 9,322,581 | B2 * | 4/2016 | Blanton | F24F 11/63 |
| 10,935,260 | B2 * | 3/2021 | Taras | F25B 41/34 |
| 2004/0089015 | A1 | 5/2004 | Knight et al. | |
| 2016/0273815 | A1 | 9/2016 | Downie et al. | |
| 2022/0146164 | A1 * | 5/2022 | Long | F25B 41/31 |

* cited by examiner

*Primary Examiner* — Ana M Vazquez
(74) *Attorney, Agent, or Firm* — Fletcher Yoder, P.C.

(57) ABSTRACT

A heat pump system includes a refrigerant circuit including a compressor, a reversing valve, a first heat exchanger, a second heat exchanger, a reheat heat exchanger, and a three-way valve. The reversing valve is configured to receive refrigerant from the compressor and adjust between a first configuration to direct the refrigerant toward the three-way valve and a second configuration to direct the refrigerant toward the first heat exchanger. The three-way valve is configured to adjust between a first position to direct the refrigerant between the reversing valve and the second heat exchanger and a second position to direct the refrigerant from the reversing valve to the reheat heat exchanger.

15 Claims, 9 Drawing Sheets

REHEAT OPERATION FOR HEAT PUMP SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In some embodiments, the HVAC system includes a heat pump system configured to operate in a heating mode to heat the supply air flow and in a cooling mode to cool the supply air flow. Thus, the heat pump system may selectively operate based on a demand for heating or cooling. However, reheat functionality may be difficult and/or costly to incorporate in the heat pump system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heat pump system includes a refrigerant circuit comprising a compressor, a reversing valve, a first heat exchanger, a second heat exchanger, a reheat heat exchanger, and a three-way valve. The reversing valve is configured to receive refrigerant from the compressor and adjust between a first configuration to direct the refrigerant toward the three-way valve and a second configuration to direct the refrigerant toward the first heat exchanger. The three-way valve is configured to adjust between a first position to direct the refrigerant between the reversing valve and the second heat exchanger and a second position to direct the refrigerant from the reversing valve to the reheat heat exchanger.

In one embodiment, a tangible, non-transitory, computer-readable medium includes instructions. The instructions, when executed by processing circuitry, are configured to cause the processing circuitry to position a reversing valve of a heat pump system in a first configuration to direct flow of refrigerant from the reversing valve toward a three-way valve of the heat pump system and position the three-way valve in a first position to direct flow of the refrigerant from the three-way valve to an outdoor heat exchanger of the heat pump system in a cooling mode of the heat pump system, position the reversing valve in the first configuration to direct flow of the refrigerant from the reversing valve toward the three-way valve and position the three-way valve in a second position to direct flow of the refrigerant from the three-way valve to a reheat heat exchanger of the heat pump system in a reheat mode of the heat pump system, and position the reversing valve in a second configuration to direct flow of the refrigerant from the reversing valve toward an indoor heat exchanger of the heat pump system in a heating mode of the heat pump system.

In one embodiment, a heat pump system includes a refrigerant circuit having a compressor, a reversing valve, a three-way valve, an indoor heat exchanger. The heat pump system also includes a control system configured to adjust the reversing valve and the three-way valve based on an operating mode selected from a heating mode, a cooling mode, and a reheat mode. The reversing valve is configured to receive refrigerant from the compressor and adjust between a first configuration to direct the refrigerant from the compressor toward the three-way valve and a second configuration to direct the refrigerant from the compressor toward the indoor heat exchanger. The three-way valve is configured to adjust between a first position to direct the refrigerant between the reversing valve and the outdoor heat exchanger and a second position to direct the refrigerant from the reversing valve to the reheat heat exchanger.

DRAWINGS

Various aspects of this disclosure may be better understood upon reading the following detailed description and upon reference to the drawings in which.

DETAILED DESCRIPTION

Figure 1:
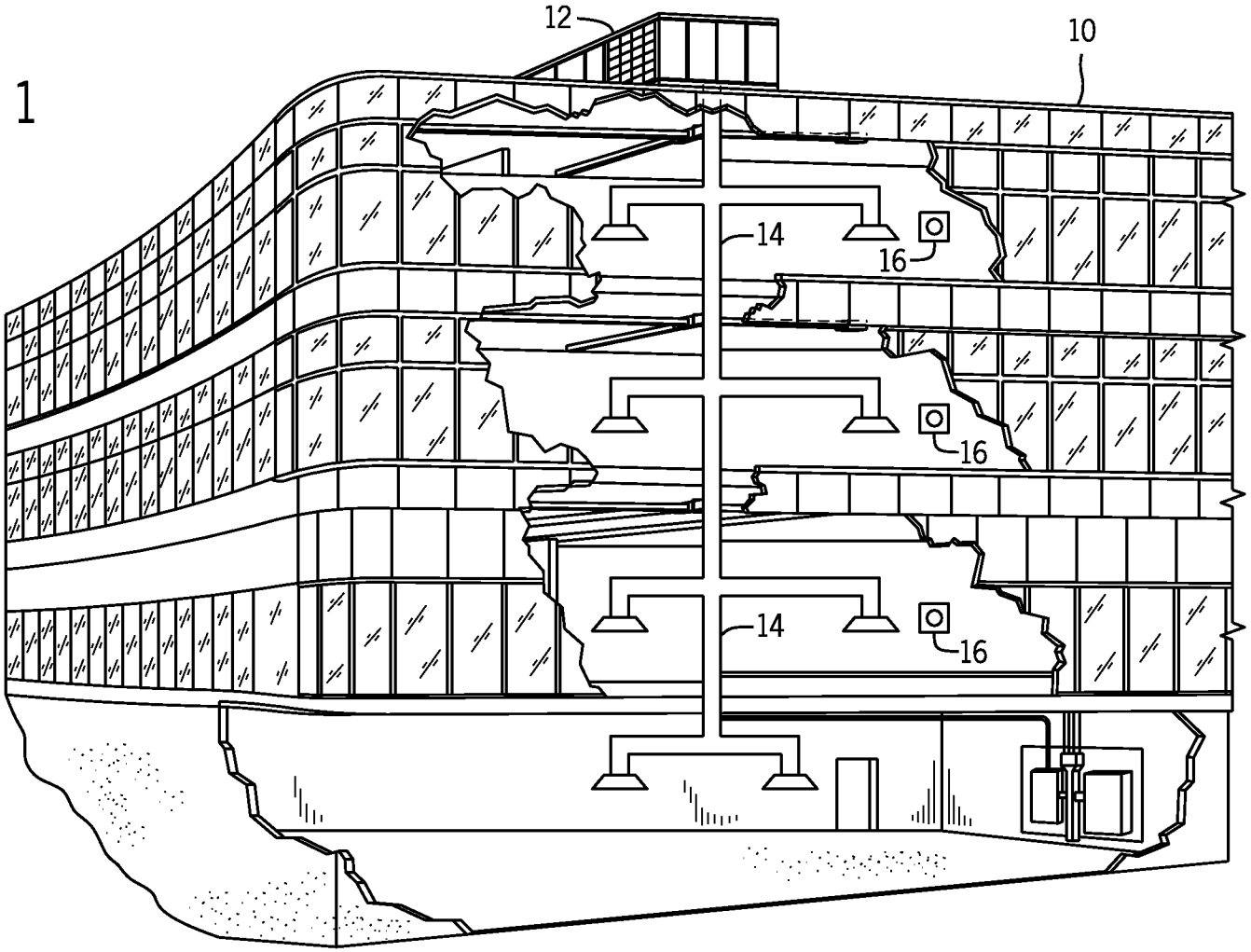
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may include a refrigerant circuit through which a refrigerant is directed. The refrigerant circuit may place the refrigerant in a heat exchange relationship with a supply air flow to condition the supply air flow. The conditioned supply air flow may then be delivered to a space to condition the space. The HVAC system may include a heat pump system configured to operate in a cooling mode or a heating mode. In the cooling mode, the HVAC system may circulate refrigerant through the refrigerant circuit in a first direction (e.g., along a first flow path), and the refrigerant may absorb heat from the supply air flow to cool the supply air flow provided to the space. In the heating mode, the HVAC system may circulate refrigerant through the refrigerant circuit in a second direction (e.g., along a second flow path), and the refrigerant may transfer heat to the supply air flow to heat the supply air flow provided to the space. For example, the refrigerant circuit may include a reversing valve configured to adjust a direction of refrigerant flow through the refrigerant circuit and thereby adjust the operating mode of the heat pump system.

In certain embodiments, it may be desirable to reheat the supply air flow after the supply air flow has been cooled by the refrigerant. For example, the refrigerant may initially absorb a certain amount of heat from the supply air flow to remove a target amount of liquid from the supply air flow (e.g., to dehumidify the supply air flow), thereby reducing a temperature of the supply air flow below a comfortable, desirable, or target temperature. Thus, reheating the air flow may be desirable to increase the temperature of the supply air flow to the comfortable, desirable, or target temperature. Unfortunately, it may be difficult to provide reheat functionality in the heat pump system. As an example, the refrigerant circuit of conventional or existing heat pump systems may not have a reheat heat exchanger to reheat the supply air flow via the refrigerant. As mentioned above, the heat pump system includes a refrigerant circuit configured to direct refrigerant therethrough in multiple directions (e.g., depending on an operating mode of the heat pump system), which may complicate incorporation of a reheat system with the heat pump system. As another example, a cost associated with incorporating and/or operating a reheat system that is separate from the refrigerant circuit of the heat pump system may be undesirable.

Accordingly, embodiments of the present disclosure are directed to a heat pump system having a refrigerant circuit configured to provide reheat functionality (e.g., discrete reheat functionality, on/off reheat functionality) in addition to operating in cooling and heating modes. For example, the refrigerant circuit may include a first heat exchanger (e.g., an indoor heat exchanger), a second heat exchanger (e.g., an outdoor heat exchanger), and a reheat heat exchanger. In a heating mode, a reversing valve may be adjusted to a first configuration to direct pressurized refrigerant from a compressor of the refrigerant circuit to the first heat exchanger. The first heat exchanger may enable the pressurized, heated refrigerant to transfer heat to a supply air flow directed across the first heat exchanger, thereby heating the supply air flow to be provided to a conditioned space. In a cooling mode, the reversing valve may be adjusted to a second configuration to direct the refrigerant from the compressor to a first valve of the refrigerant circuit. The first valve may be adjusted to a first position to direct the refrigerant to the second heat exchanger for cooling the refrigerant. Thereafter, the refrigerant circuit may direct the refrigerant to the first heat exchanger to cool the supply air flow to be provided to the conditioned space. In the cooling mode, the first valve may block the refrigerant from flowing to the reheat heat exchanger, and reheat functionality of the refrigerant circuit may be suspended.

In a reheat mode, the reversing valve may be adjusted to the second configuration to direct the refrigerant from the compressor to the first valve, and the first valve may be adjusted to a second position to direct the refrigerant to the reheat heat exchanger. At the reheat heat exchanger, heat is transferred from the refrigerant to the supply air flow, thereby cooling the refrigerant and heating the supply air flow. From the reheat heat exchanger, the refrigerant circuit may direct the refrigerant to the first heat exchanger, where the cooled refrigerant may absorb heat from the supply air flow. In this way, the reheat heat exchanger may enable heat exchange between the supply air flow and heated refrigerant, and the first heat exchanger may enable heat exchange between the supply air flow and cooled refrigerant. For example, the reheat mode may enable the heat pump system to deliver a dehumidified supply air flow at a comfortable temperature to the conditioned space. Accordingly, the heat pump system may be configured to operate in various operating modes to condition the space in a desirable manner.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
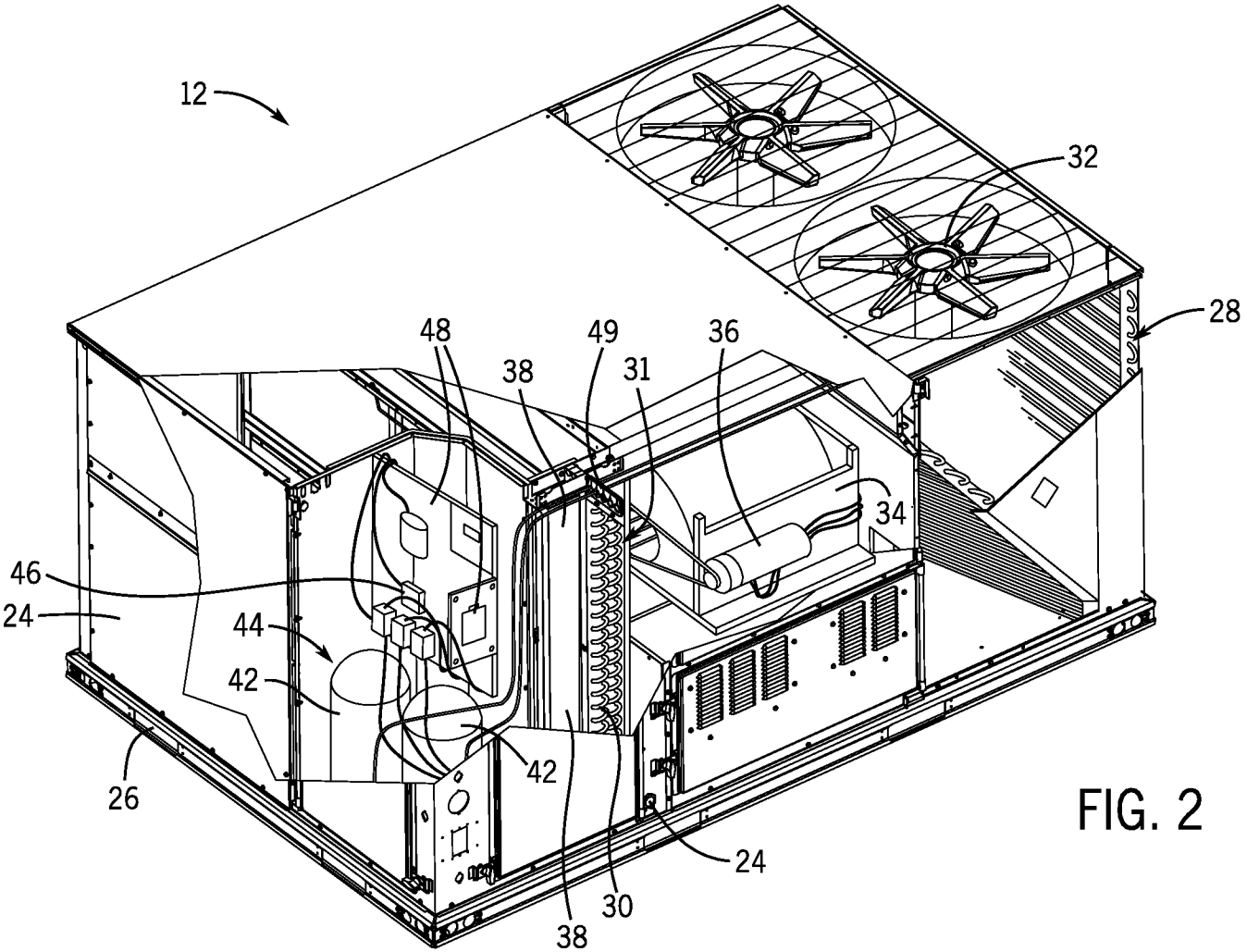
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
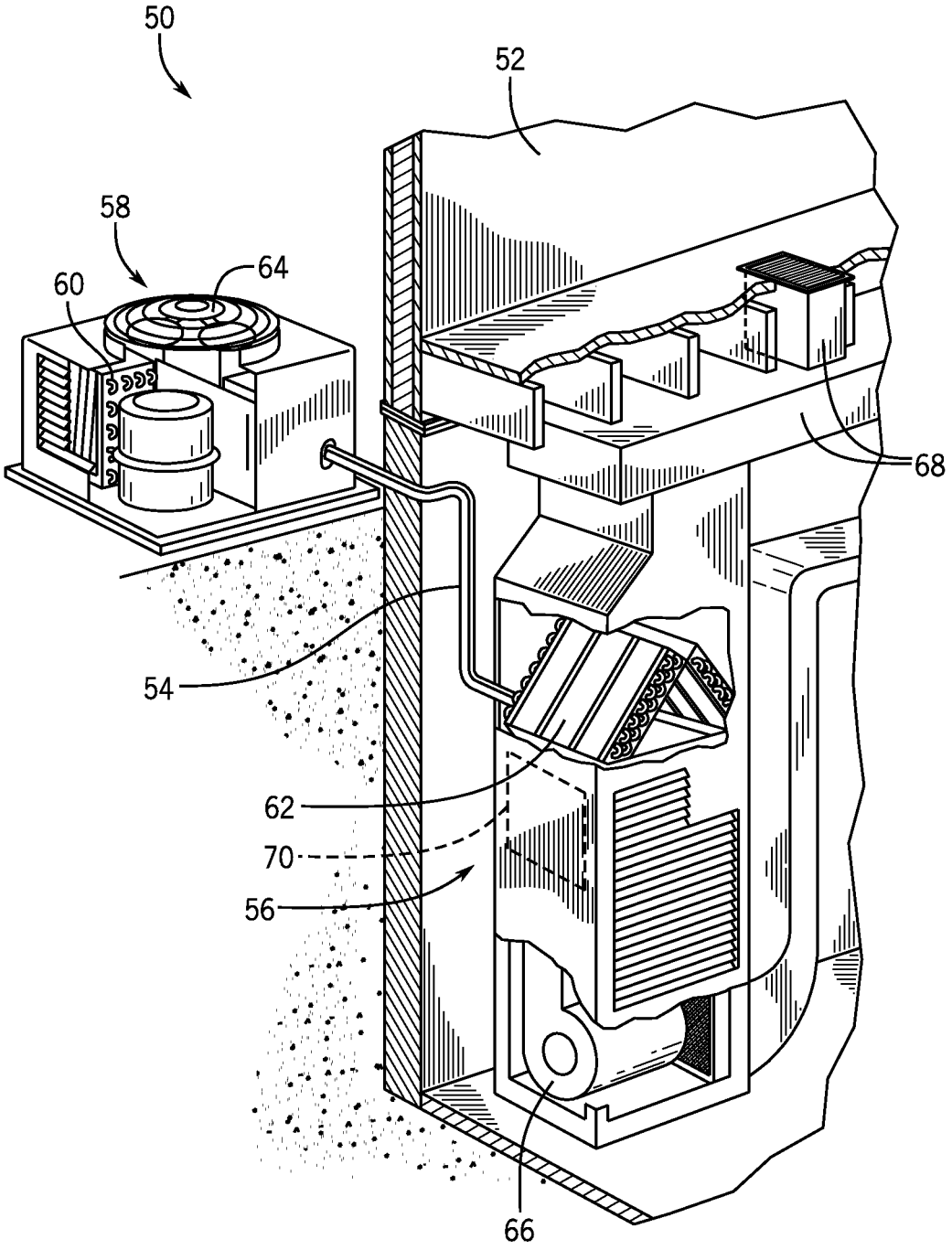
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
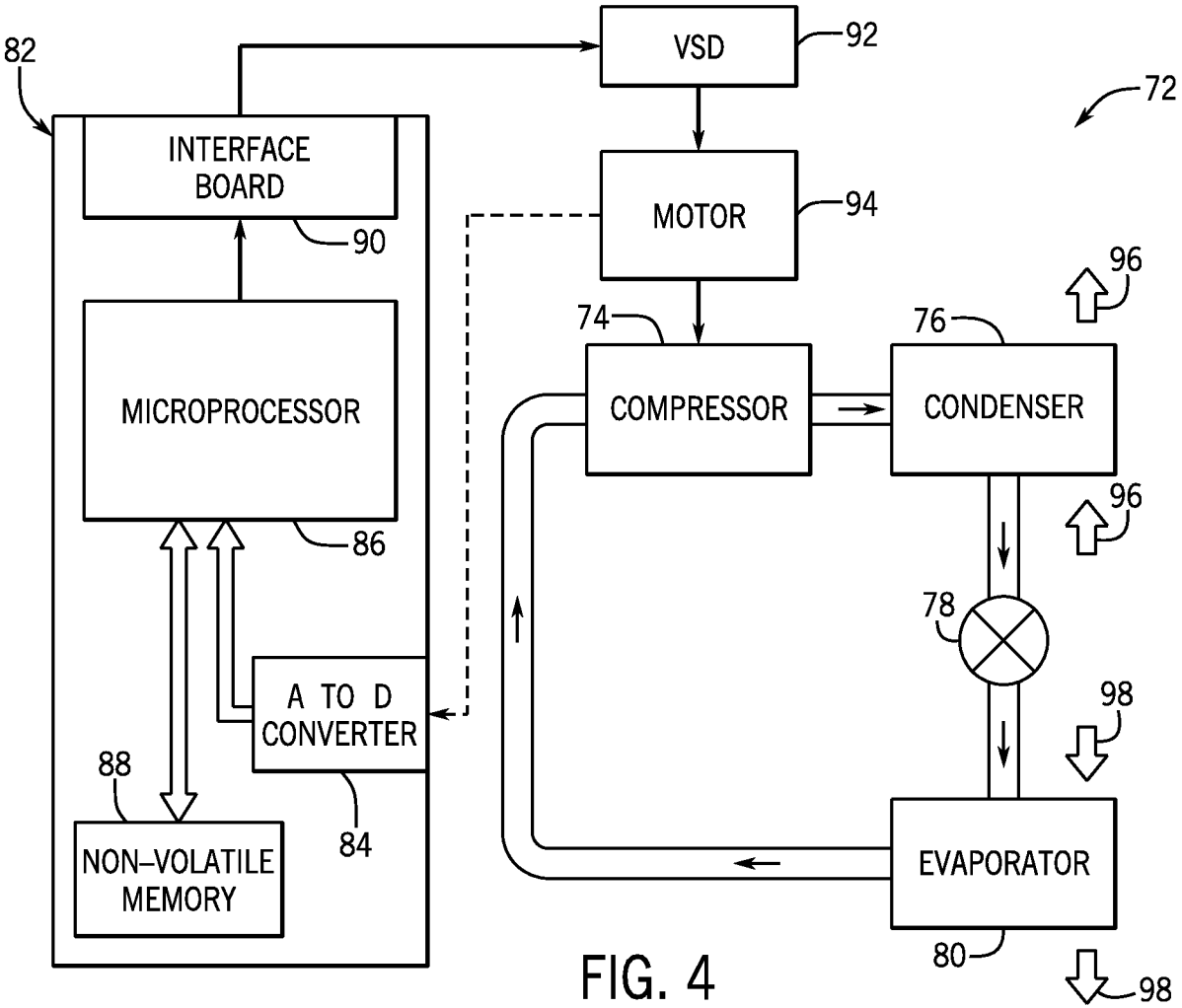
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a heat pump system having a refrigerant circuit configured to operate in a heating mode, a cooling mode, and a reheat mode. In the heating mode, refrigerant is directed through the refrigerant circuit from a compressor to a first heat exchanger (e.g., an indoor heat exchanger) to enable the refrigerant to heat a supply air flow. In the cooling mode, the refrigerant is directed through the refrigerant circuit from the compressor to a second heat exchanger (e.g., an outdoor heat exchanger) to cool the refrigerant, and the cooled refrigerant is directed to the first heat exchanger to cool the supply air flow. In the reheat mode, the refrigerant is directed through the refrigerant circuit from the compressor to a reheat heat exchanger to heat (e.g., reheat) the supply air flow and cool the refrigerant, and the cooled refrigerant is directed to the first heat exchanger to cool the supply air flow. For example, the first heat exchanger may be positioned upstream of the reheat heat exchanger relative to a flow direction of the supply air flow. Thus, in the reheat mode, the heat pump system may cool the supply air flow, via the first heat exchanger, to remove an amount of moisture in the supply air flow and then reheat the supply air flow, via the reheat heat exchanger, to a target or desirable temperature. The heat pump system may be operated to enable or block refrigerant flow to the reheat heat exchanger to enable or suspend reheat operations, respectively.

Figure 5:
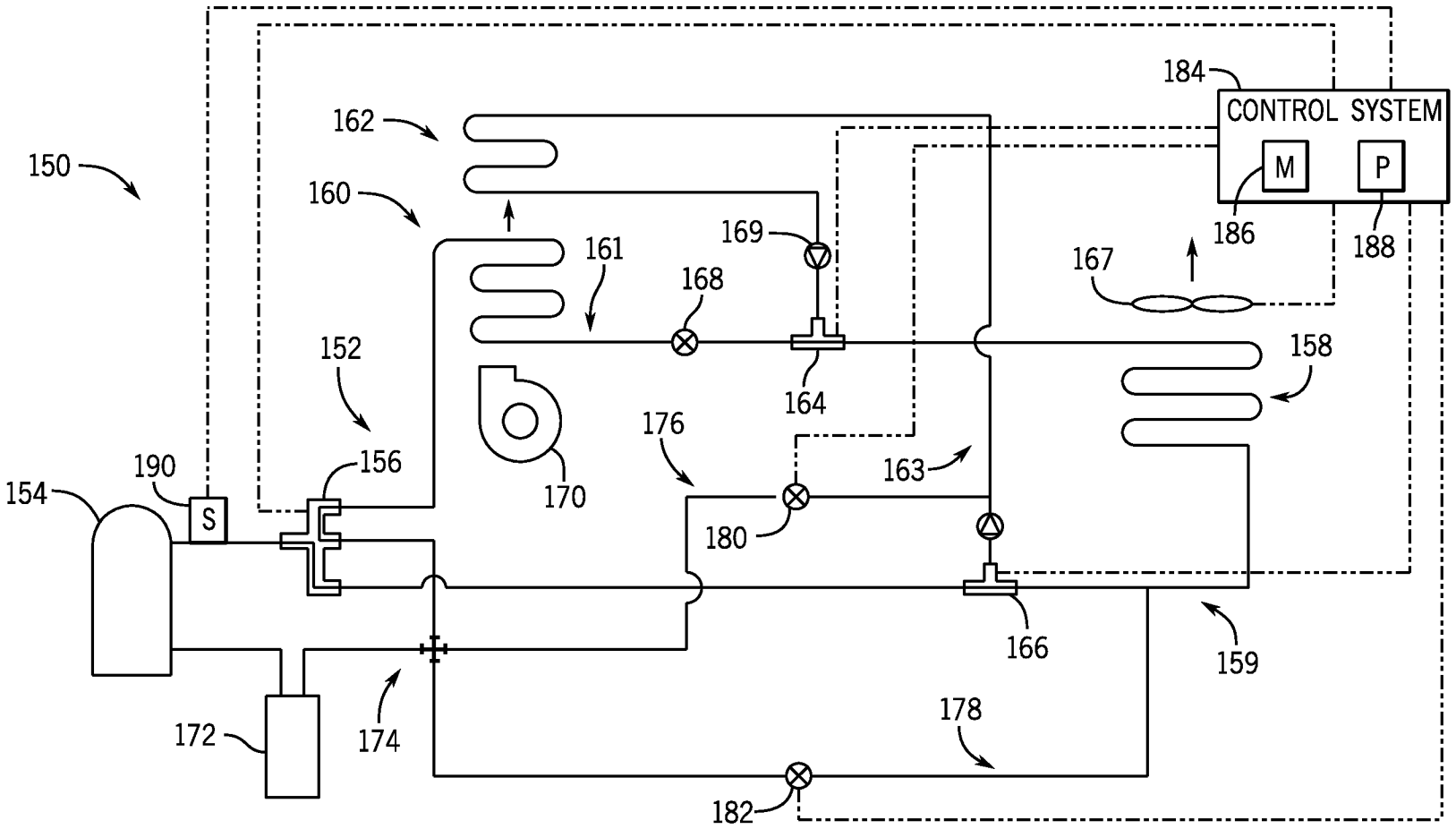
FIG. 5 is a schematic diagram of an embodiment of a heat pump system having reheat functionality and operating in a cooling mode, in accordance with an aspect of the present disclosure.

With this in mind, FIG. 5 is a schematic diagram of an embodiment of a heat pump system 150 having a refrigerant circuit 152 through which a refrigerant is directed. The refrigerant circuit 152 includes a compressor 154 configured to pressurize the refrigerant, thereby increasing a temperature of the refrigerant. The refrigerant circuit 152 includes a reversing valve 156 configured to receive the pressurized refrigerant from the compressor 154. The reversing valve 156 may be transitioned between different configurations (e.g., by adjusting the position of a slider within the reversing valve 156) to direct the refrigerant in different manners (e.g., in different directions, along different flow paths) through the refrigerant circuit 152. For example, the refrigerant circuit 152 may include a first heat exchanger or coil 158 (e.g., an outdoor heat exchanger or coil) disposed along a first line (e.g., a first conduit, a first flow path) 159 of the refrigerant circuit 152 and a second heat exchanger or coil 160 (e.g., an indoor heat exchanger or coil) disposed along a second line (e.g., a second conduit, a second flow path) 161 of the refrigerant circuit 152. The reversing valve 156 may be controlled (e.g., adjusted) to direct the refrigerant through the refrigerant circuit 152 in different directions. For example, the reversing valve 156 may be controlled to direct the refrigerant through components of the refrigerant circuit 152 (e.g., the first heat exchanger 158, the second heat exchanger 160, and the compressor 154) in a particular order or sequence.

Further, the refrigerant circuit 152 may include a reheat heat exchanger or coil 162 disposed along a reheat line (e.g., a reheat conduit, a reheat flow path) 163 of the refrigerant circuit 152, as well as a first valve 164 (e.g., a three-way valve) and a second valve 166 (e.g., a three-way valve) configured to adjustably enable or block refrigerant flow to the reheat heat exchanger 162. For example, each of the first valve 164 and the second valve 166 may be configured to transition between a first position (e.g., an off position or a closed position), which may block refrigerant flow into and/or out of the reheat line 163, and a second position (e.g., an on position or an open position), which may enable refrigerant flow into and/or out of the reheat line 163. In this manner, the reversing valve 156, the first valve 164, and the second valve 166 may be controlled to operate the heat pump system 150 in different operating modes.

In the illustrated embodiment, the heat pump system 150 is shown in a cooling mode configuration in which reheat operation may be suspended. During the cooling mode, the reversing valve 156 is positioned in a first configuration to direct pressurized refrigerant from the compressor 154 toward the second valve 166. The second valve 166 is adjusted to the first position to direct the pressurized refrigerant to the first heat exchanger 158 via the first line 159 fluidly coupled to the second valve 166 and to block refrigerant flow to the reheat heat exchanger 162 via the reheat line 163 fluidly coupled to the second valve 166. Thus, operation of the reheat heat exchanger 162 may be suspended during the cooling mode. A first fan or blower 167 (e.g., an outdoor fan or blower) may be operated to direct (e.g., draw, force) an air flow, such as outdoor air or ambient air, across the first heat exchanger 158 to cool the pressurized refrigerant flowing within the first heat exchanger 158. The cooled refrigerant may then be directed to the first valve 164. The first valve 164 may be adjusted to the first position to block the cooled refrigerant from flowing into the reheat line 163 and to direct the cooled refrigerant to an expansion valve 168 configured to reduce the pressure of the refrigerant, thereby further cooling the refrigerant. In certain embodiments, the reheat line 163 may also include a check valve 169 configured to block the refrigerant from flowing from the first valve 164 to the reheat heat exchanger 162.

The expansion valve 168 may direct the refrigerant to the second heat exchanger 160 via the second line 161, and a second fan or blower 170 (e.g., an indoor fan or blower) may direct (e.g., draw, force) a supply air flow, such as outdoor air and/or return air, across the second heat exchanger 160. The cooled refrigerant flowing through the second heat exchanger 160 may absorb heat from the supply air flow, thereby cooling the supply air flow. The supply air flow may then be directed to a space (e.g., within a building or structure) to condition the space. After exchanging heat with the supply air flow, the refrigerant may be directed from the second heat exchanger 160 to the reversing valve 156, and the reversing valve 156 may direct the refrigerant from the second heat exchanger 160 to an accumulator 172 via a junction 174 of the refrigerant circuit 152. The accumulator 172 may collect refrigerant and/or direct the refrigerant to the compressor 154 for pressurization (e.g., during operation of the compressor 154) to re-circulate the refrigerant through the refrigerant circuit 152.

The illustrated heat pump system 150 also includes a first drain line 176 and a second drain line 178. Each of the drain lines 176, 178 may enable the refrigerant to flow from an unused section of the refrigerant circuit 152 toward the accumulator 172 and/or the compressor 154 in order to increase an amount of refrigerant available for pressurization by the compressor 154. For example, the first drain line 176 may enable the refrigerant to flow from the reheat line 163 to the junction 174, and the second drain line 178 may enable the refrigerant to flow from the first line 159 to the junction 174. For this reason, in the cooling mode, in which the refrigerant may be blocked from flowing into the reheat line 163, a third valve 180 (e.g., an on/off valve) disposed along the first drain line 176 may be adjusted to an open position to enable the refrigerant to flow out of the reheat line 163 to the accumulator 172. Further, in the cooling mode, a fourth valve 182 (e.g., an on/off valve) disposed along the second drain line 178 may be adjusted to a closed position to block the refrigerant from flowing between the second drain line 178 and the junction 174, thereby enabling the refrigerant to flow from the first line 159 (e.g., the first heat exchanger 158) toward the second heat exchanger 160.

The heat pump system 150 may also include a control system 184 configured to control various components of the heat pump system 150. The control system 184 may include a memory 186 and processing circuitry 188. The memory 186 may include a tangible, non-transitory, computer-readable medium that may store instructions that, when executed by the processing circuitry 188, may cause the processing circuitry 188 to perform various functions or operations described herein. To this end, the processing circuitry 188 may be any suitable type of computer processor or microprocessor capable of executing computer-executable code, including but not limited to one or more field programmable gate arrays (FPGA), application-specific integrated circuits (ASIC), programmable logic devices (PLD), programmable logic arrays (PLA), and the like. As an example, the control system 184 may be configured to control the reversing valve 156, the first valve 164, and/or the second valve 166 based on an operating mode selected from the different operating modes described herein. The control system 184 may also be configured to control the third valve 180 and/or the fourth valve 182 to control drainage of the refrigerant from the reheat line 163 and/or the first line 159, respectively. For instance, the valves 164, 166, 180, 182 may be solenoid valves configured to open or close based on signals (e.g., control signals) received from the control system 184. In some embodiments, the signals may cause the valves 164, 166, 180, 182 to close, and the valves 164, 166, 180, 182 may remain open while the signals are not received. In other words, the valves 164, 166, 180, 182 may be normally-open valves. Additionally or alternatively, the signals may cause the valves 164, 166, 180, 182 to open, and the valves 164, 166, 180, 182 may remain closed while the signals are not received. In other words, the valves 164, 166, 180, 182 may be normally-closed valves.

In certain embodiments, the first fan 167 may be a variable speed fan. The control system 184 or a separate control system (e.g., a control system specifically configured to operate the first fan 167) may be configured to operate the variable speed fan at a target operating speed. For instance, the control system 184 may operate the first fan 167 to direct a target amount (e.g., a target flow rate) of air flow across the first heat exchanger 158 to cool the refrigerant while maintaining a pressure of the refrigerant above a threshold pressure to enable the refrigerant to flow toward the first valve 164 at a threshold or sufficient flow rate. In other words, the control system 184 may operate the first fan 167 to avoid overcooling the refrigerant, thereby avoiding reduction of the flow rate of the refrigerant below the threshold flow rate. In additional or alternative embodiments, the first fan 167 may be one of a plurality of fans (e.g., a fan array) that are independently controllable, and the control system 184 may be configured to operate the plurality of fans (e.g., to suspend operation of a subset of the plurality of fans) to maintain the pressure of the refrigerant above the threshold pressure. To this end, the control system 184 may also operate the first fan 167 based on a determined or measured operating parameter indicative of the pressure of the refrigerant exiting the first heat exchanger 158, such as the pressure of the refrigerant, a temperature of the refrigerant, a detected flow rate of the refrigerant (e.g., to the expansion valve 168), a temperature of outdoor air, and the like.

The refrigerant circuit 152 may include one or more sensors 190 communicatively coupled to the control system 184. The sensor(s) 190 may be configured to determine an operating parameter of the heat pump system 150, and the sensor(s) 190 may transmit data indicative of the operating parameter to the control system 184. The control system 184 may operate the heat pump system 150 based on the operating parameter. By way of example, the operating parameter may include a temperature and/or pressure of the refrigerant (e.g., within the second heat exchanger 160, within the first heat exchanger 158), a temperature of the supply air flow, a temperature and/or humidity within a space conditioned by the heat pump system 150, a temperature of outdoor air, another suitable operating parameter, or any combination thereof. The control system 184 may operate the valves 156, 164, 166, 180, 182 based on the data received from the sensor(s) 190 in order to operate the heat pump system 150 in a particular operating mode. The control system 184 may additionally or alternatively operate another suitable component, such as the compressor 154, the first fan 167, the second fan 170, and so forth (e.g., based on a selected operating mode of the heat pump system 150).

Figure 6:
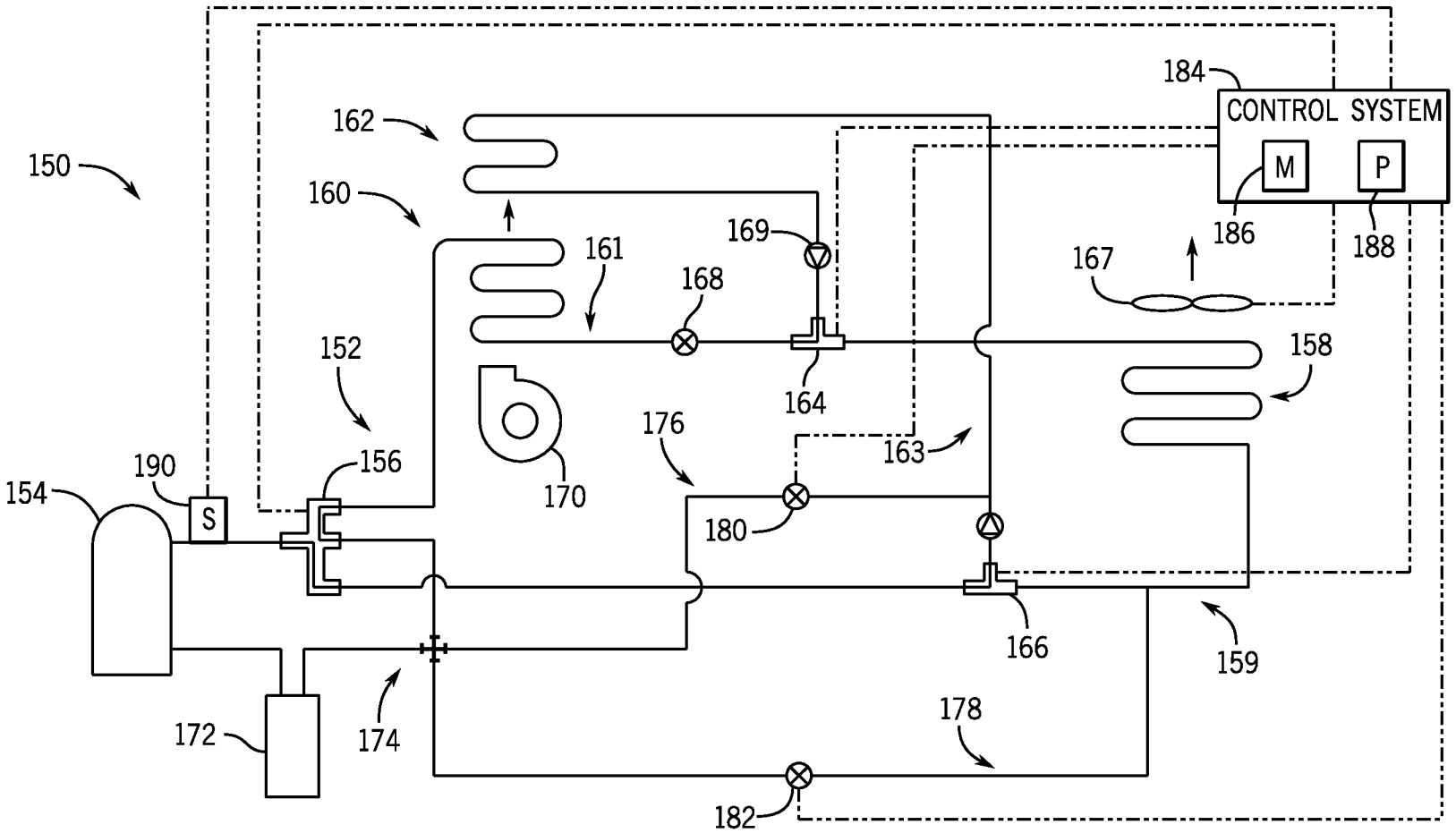
FIG. 6 is a schematic diagram of an embodiment of a heat pump system having reheat functionality and operating in a reheat mode, in accordance with an aspect of the present disclosure.

FIG. 6 is a schematic diagram of an embodiment of the heat pump system 150 in a reheat mode configuration. During the reheat mode, the reversing valve 156 may be positioned in the first configuration to direct the pressurized refrigerant from the compressor 154 to the second valve 166. The second valve 166 may be adjusted to the second position to direct the pressurized refrigerant to the reheat heat exchanger 162 via the reheat line 163 and to block the pressurized refrigerant from flowing to the first heat exchanger 158 via the first line 159. Further, the first valve 164 may be adjusted to the second position to direct the refrigerant from the reheat heat exchanger 162 toward the expansion valve 168 and to block the refrigerant from flowing from the reheat heat exchanger 162 to the first heat exchanger 158. The expansion valve 168 may then direct the refrigerant to the second heat exchanger 160 and then to the reversing valve 156, and the reversing valve 156 may direct the refrigerant from the second heat exchanger 160 to the accumulator 172 via the junction 174.

The second fan 170 may be operated to direct the supply air flow across both the second heat exchanger 160 and the reheat heat exchanger 162. Accordingly, the reheat heat exchanger 162 may place pressurized, heated refrigerant in a heat exchange relationship with the supply air flow to heat (e.g., reheat) the supply air flow and cool the refrigerant, and the second heat exchanger 160 may place the cooled refrigerant in a heat exchange relationship with the supply air flow to cool the supply air flow. As shown, the second heat exchanger 160 is positioned upstream of the reheat heat exchanger 162 relative to the supply air flow directed thereacross. Thus, the second heat exchanger 160 may first cool the supply air flow to condense moisture contained within the supply air flow, thereby reducing the temperature and humidity of the supply air flow, and the reheat heat exchanger 162 may heat (e.g., reheat) the dehumidified supply air flow to a comfortable temperature. For instance, the heat pump system 150 may operate in the reheat mode to dehumidify the space serviced by the heat pump system 150 without substantially changing a temperature of the space.

In the reheat mode, the refrigerant may be blocked from flowing into the first line 159 (e.g., via the valves 164, 166), and operation of the first heat exchanger 158 and/or the first fan 167 may be suspended. For this reason, the fourth valve 182 may be opened to enable refrigerant to flow out of the first line 159 toward the accumulator 172 via the second drain line 178. Furthermore, the third valve 180 may be closed to block the refrigerant from flowing between the reheat line 163 and the junction 174 via the first drain line 176.

Figure 7:
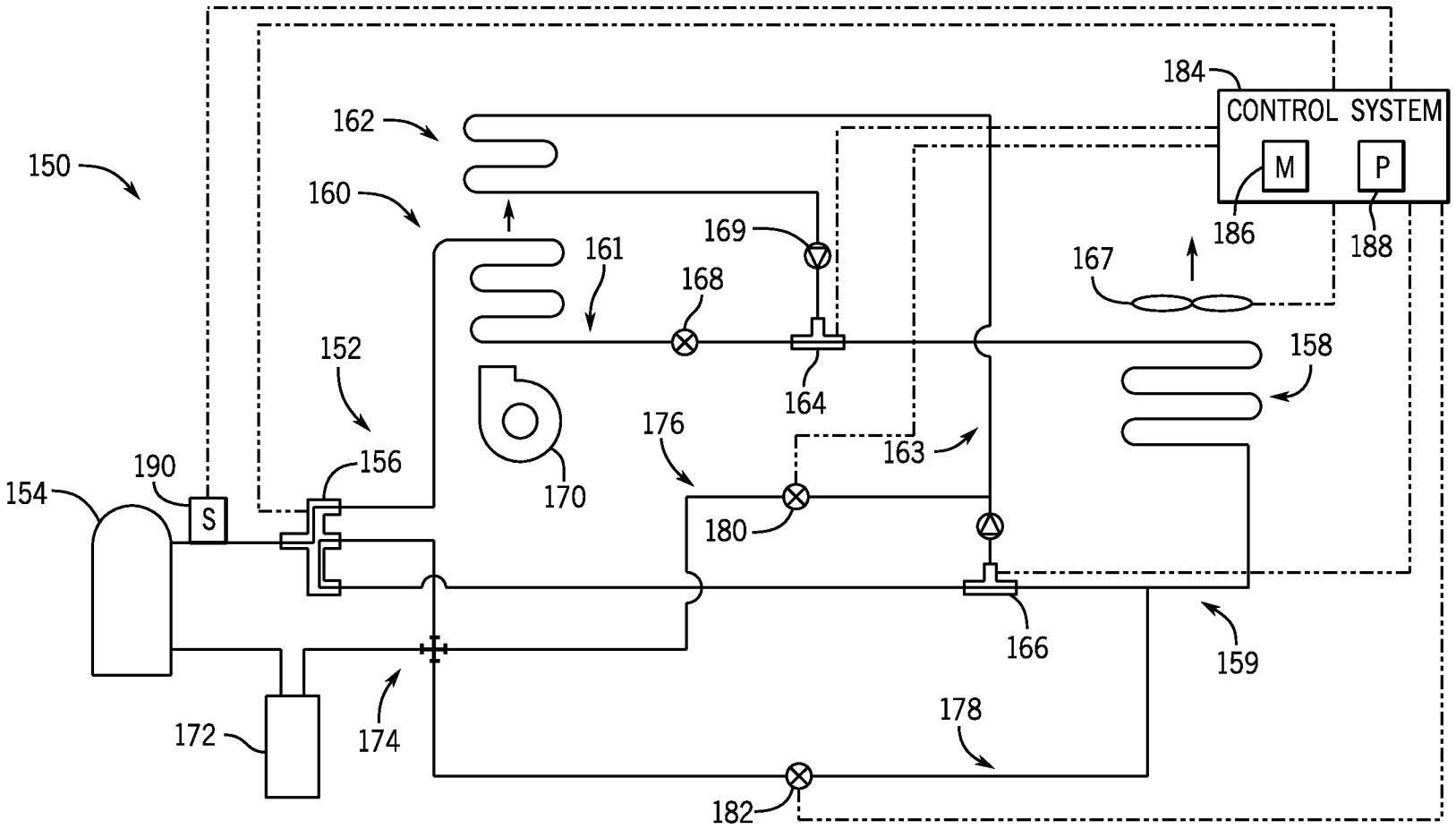
FIG. 7 is a schematic diagram of an embodiment of a heat pump system having reheat functionality and operating in a heating mode, in accordance with an aspect of the present disclosure.

FIG. 7 is a schematic diagram of an embodiment of the heat pump system 150 in a heating mode configuration. During the heating mode, the reversing valve 156 may be positioned in the second configuration to direct the pressurized refrigerant from the compressor 154 to the second heat exchanger 160. The second fan 170 may direct the supply air flow across the second heat exchanger 160 to place the supply air flow in a heat exchange relationship with the pressurized, heated refrigerant in order to heat the supply air flow and cool the refrigerant. The supply air flow may then be directed into the space to heat the space. The cooled refrigerant may be directed from the second heat exchanger 160 to the first valve 164, which may be adjusted to the first position to direct the refrigerant to the first heat exchanger 158 via the first line 159 and to block the refrigerant from flowing into the reheat line 163. The first heat exchanger 158 may place the refrigerant in a heat exchange relationship with the outdoor air in order to heat the refrigerant. The refrigerant may then be directed from the first heat exchanger 158 to the second valve 166, which may be adjusted to the first position in order to direct the refrigerant to the reversing valve 156 and to block the refrigerant from flowing into the reheat line 163. The reversing valve 156 may direct the refrigerant from the second valve 166 to the junction 174 and toward the accumulator 172 in the second configuration.

In the heating mode, the refrigerant may be blocked from flowing into the reheat line 163, and operation of the reheat heat exchanger 162 may be suspended. As such, the third valve 180 may be opened to enable refrigerant to flow out of the reheat line 163 toward the accumulator 172 via the first drain line 176. Additionally, the fourth valve 182 may be closed to block the refrigerant from flowing between the first line 159 and the junction 174 via the second drain line 178.

Figure 8:
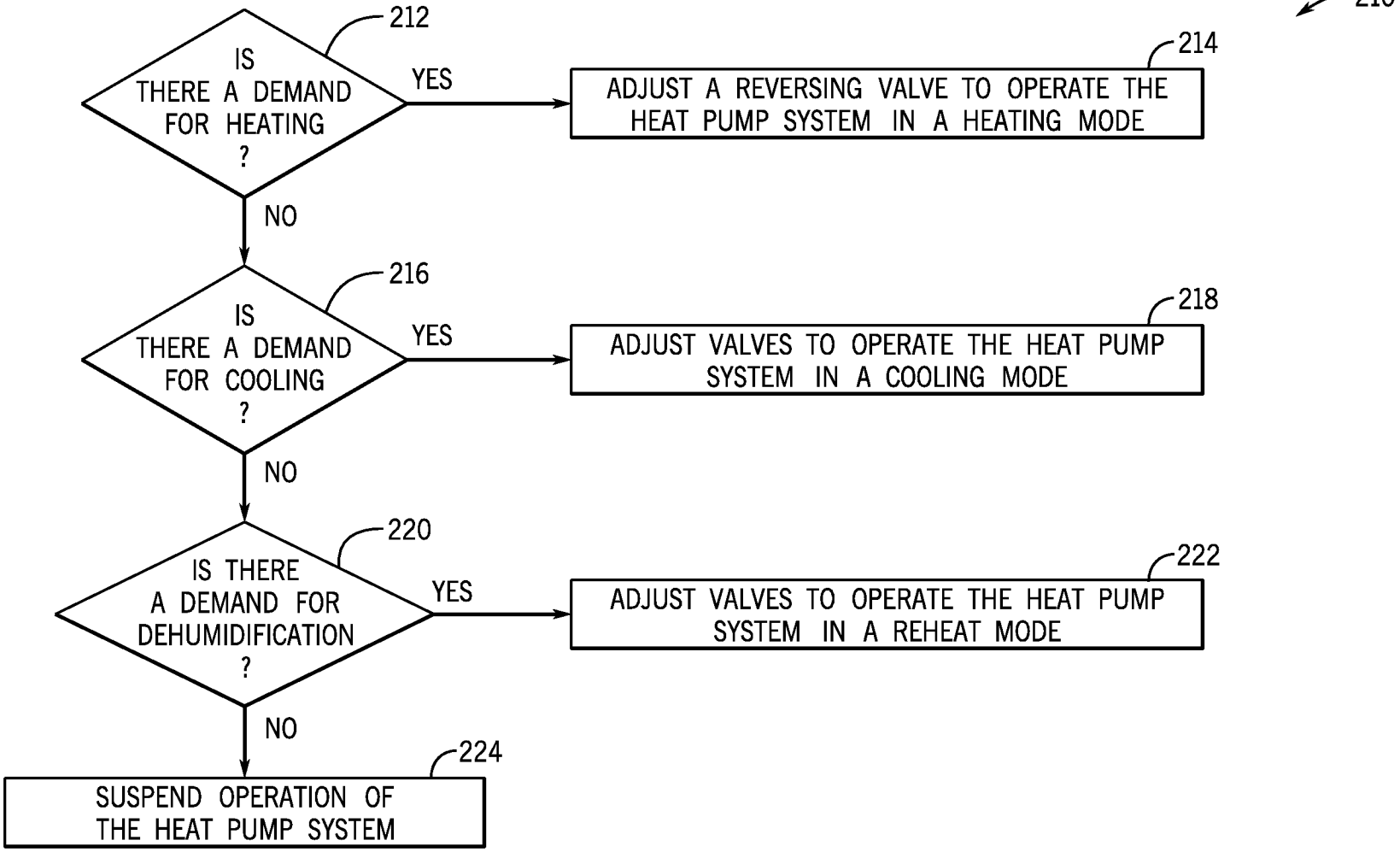
FIG. 8 is a flowchart of an embodiment of a method for operating a heat pump system having reheat functionality, in accordance with an aspect of the present disclosure.

FIG. 8 is a flowchart of an embodiment of a method 210 for operating the heat pump system 150 in different operating modes. As an example, the control system 184 (e.g., the processing circuitry 188) may perform one or more steps in the illustrated method 210. It should be noted that the method 210 may be performed in a different manner in additional or alternative embodiments. For instance, additional steps may be performed with respect to the described method 210. Additionally or alternatively, certain steps of the depicted method 210 may be removed, modified, and/or performed in a different order.

At block 212, a determination is made regarding whether there is a demand for heating. In certain embodiments, the determination may be made based on data received from the sensor(s) 190. As an example, the determination may be made based on a comparison between a current (e.g., measured) temperature within a space serviced by the heat pump system 150 and a target or desired temperature within the space, such as whether the current temperature is below the target temperature. In additional or alternative embodiments, the determination may be made based on a user input. By way of example, the user input may be indicative of a request to heat the space regardless of the current temperature within the space.

At block 214, in response to a determination that there is a demand for heating (e.g., the current temperature of the space is below the target temperature), the heat pump system 150 may be operated in the heating mode. For example, the reversing valve 156 may be adjusted to the second configuration to direct pressurized refrigerant to the second heat exchanger 160, as shown in FIG. 7. Moreover, each of the first valve 164 and the second valve 166 may be adjusted to respective first positions to block the refrigerant from flowing into and/or from the reheat line 163, and operation of the reheat heat exchanger 162 may be suspended. Further, the second fan 170 may be operated to direct the supply air flow across the second heat exchanger 160 to heat the supply air flow to a target temperature and/or to deliver the supply air flow at a desirable flow rate into the space. Further still, the third valve 180 may be opened to enable refrigerant to flow out of the reheat line 163 and toward the accumulator 172 via the junction 174, and the fourth valve 182 may be closed to block refrigerant from flowing between the first line 159 and the junction 174.

At block 216, in response to a determination that there is not a demand for heating, a determination may be made regarding whether there is a demand for cooling. By way of example, the determination may be made based on a comparison between the current (e.g., measured) temperature within the space and the target temperature, such as whether the current temperature is above the target temperature. In additional or alternative embodiments, the determination may be made based on a user input, such as a user input indicative of a request to cool the space regardless of the current temperature within the space.

At block 218, in response to a determination that there is a demand for cooling (e.g., the current temperature of the space is above the target temperature), the heat pump system 150 may be operated in the cooling mode. In the cooling mode, the reversing valve 156 may be positioned in the first configuration to direct pressurized refrigerant to the second valve 166, as shown in FIG. 5. Additionally, each of the first valve 164 and the second valve 166 may be adjusted to respective first positions to block the refrigerant from flowing through the reheat heat exchanger 162, and operation of the reheat heat exchanger 162 may be suspended. In some embodiments, the second fan 170 may be operated to direct the supply air flow across the second heat exchanger 160 to cool the supply air flow to a target temperature and/or to deliver the supply air flow at a desirable flow rate into the space. In additional or alternative embodiments, the first fan 167 may be operated to cool the refrigerant flowing through the first heat exchanger 158 while enabling the refrigerant to flow toward the second heat exchanger 160 at a target flow rate. In further embodiments, the third valve 180 may be opened to enable the refrigerant to be directed out of the reheat line 163 and toward the accumulator 172 via the junction 174, and the fourth valve 182 may be closed to block the refrigerant from flowing between the first line 159 and the junction 174.

At block 220, in response to a determination that there is not a demand for cooling, a determination may be made regarding whether there is a demand for dehumidification. As an example, the determination may be made based on a comparison between a current (e.g., measured) humidity of the space and a target humidity of the space, such as whether the current humidity is above the target humidity. In additional or alternative embodiments, the determination may be made based on a user input, such as a user input indicative of a request for dehumidifying the space regardless of the current humidity within the space.

At block 222, in response to a determination that there is a demand for dehumidification (e.g., the current humidity of the space is above the target humidity), the heat pump system 150 may be operated in the reheat mode. In the reheat mode, the reversing valve 156 may be positioned in the first configuration to direct pressurized refrigerant to the second valve 166, as shown in FIG. 6. Furthermore, each of the first valve 164 and the second valve 166 may be adjusted to respective second positions to enable the refrigerant to flow through the reheat heat exchanger 162 and to block the refrigerant from flowing through the first heat exchanger 158. Thus, operation of the first heat exchanger 158 and/or of the first fan 167 may be suspended. In certain embodiments, the second fan 170 may be operated to direct the supply air flow across the second heat exchanger 160 and the reheat heat exchanger 162 to dehumidify and/or cool the supply air flow to a target humidity and/or temperature, respectively, to reheat dehumidified supply air flow to a target temperature, and/or to deliver the supply air flow at a desirable flow rate into the space. In addition, the fourth valve 182 may be opened to enable refrigerant to flow out of the first line 159 and toward the accumulator 172 via the junction 174, and the third valve 180 may be closed to block refrigerant from flowing between the first line 159 and the junction 174.

At block 224, in response to a determination that there is no demand for heating, cooling, or dehumidification, operation of the heat pump system 150 may be suspended. For example, operation of the compressor 154 may be suspended such that the refrigerant is not directed through the refrigerant circuit 152. Further, operation of other components (e.g., the first fan 167, the second fan 170) may be suspended to reduce energy consumption associated with operation of the heat pump system 150.

It should be noted that blocks 212, 216, 220 may be continually performed to determine a suitable or desired operating mode of the heat pump system 150. As an example, a demand for heating, cooling, or dehumidification may be continually monitored while the heat pump system 150 is operating in the heating mode, the cooling mode, or the reheat mode, such as to determine whether a current operating mode is to be maintained and/or is to be changed to a different operating mode. As another example, the demand for heating, cooling, or dehumidification may be continually monitored while operation of the heat pump system 150 is suspended, such as to determine whether operation of the heat pump system 150 is to remain suspended or whether a particular operating mode of the heat pump system 150 is to be initiated.

Figure 9:
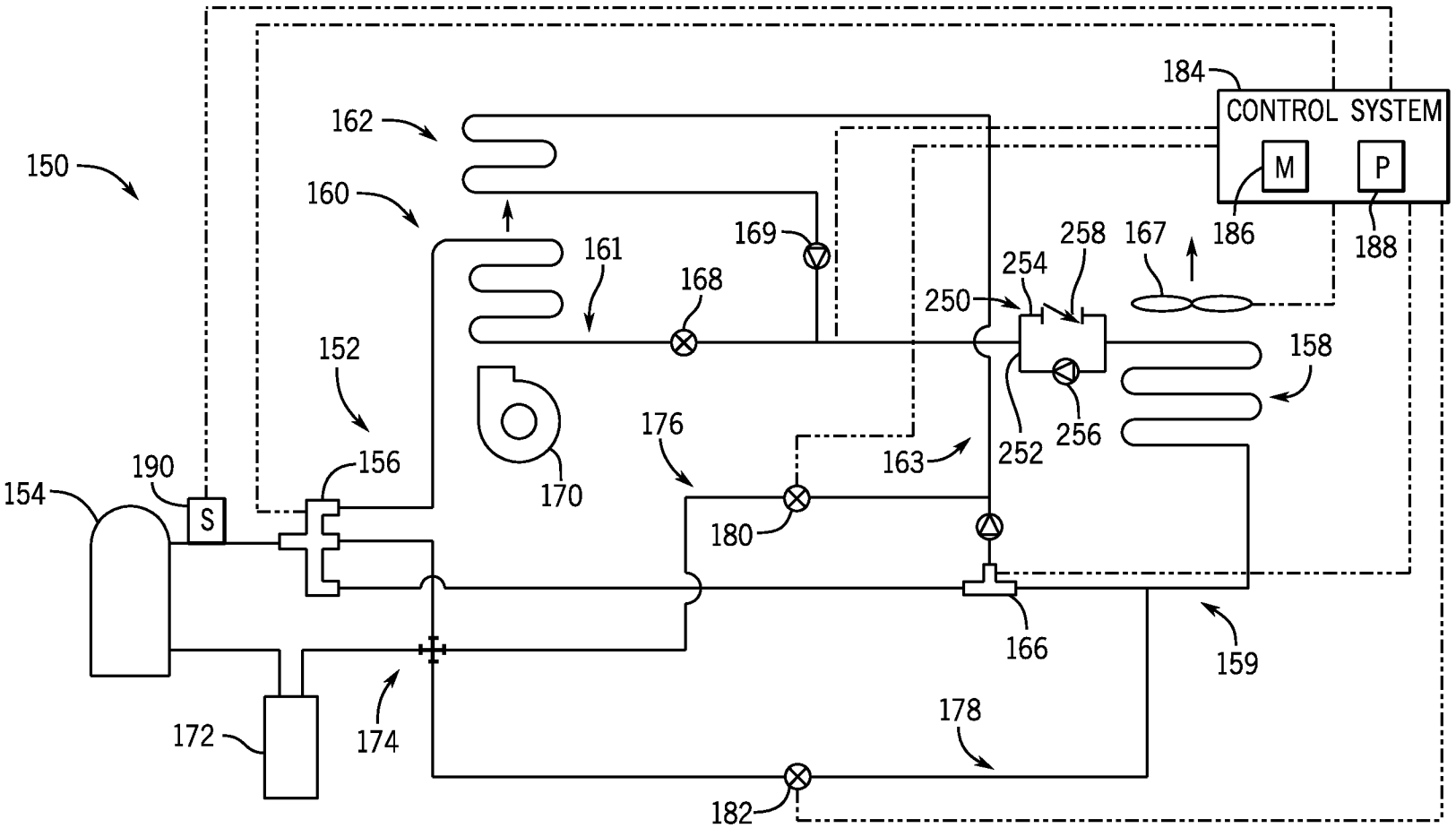
FIG. 9 is a schematic diagram of an embodiment of a heat pump system having reheat functionality, in accordance with an aspect of the present disclosure.

FIG. 9 is a schematic diagram of an embodiment of the heat pump system 150. The illustrated heat pump system 150 may be configured to operate in the cooling mode, heating mode, and/or reheat mode. The illustrated heat pump system 150 includes the check valve 169 and the second valve 166 configured to block refrigerant flow into the reheat line 163 during the cooling mode and/or the heating mode.

However, instead of the first valve 164, the refrigerant circuit 152 may include a flow path system 250 that includes a first flow path 252 and a second flow path 254 arranged in parallel with one another and extending between the first heat exchanger 158 and the second heat exchanger 160 to control refrigerant flow through the first line 159. The first flow path 252 may include a check valve 256 configured to enable refrigerant flow from the first heat exchanger 158 toward the expansion valve 168 and the second heat exchanger 160 via the first flow path 252 (e.g., in the cooling mode) and to block refrigerant flow from the expansion valve 168 to the first heat exchanger 158 via the first flow path 252 (e.g., in the reheat mode). In addition, the second flow path 254 may include a valve (e.g., on/off valve) 258 that may transition between an open (e.g., on) position and a closed (e.g., off) position. In the open position, the on/off valve 258 may enable refrigerant flow between the first heat exchanger 158 and the expansion valve 168 via the second flow path 254. In the closed position, the on/off valve 258 may block refrigerant flow between the first heat exchanger 158 and the expansion valve 168 via the second flow path 254. As an example, the on/off valve 258 may be adjusted to the open position during the heating mode of the heat pump system 150 to enable refrigerant flow from the expansion valve 168 to the first heat exchanger 158 via the second flow path 254 (e.g., instead of via the first flow path 252). Further, the on/off valve 258 may be adjusted to the closed position during the cooling mode and/or the reheat mode of the heat pump system 150 to block the refrigerant from flowing between the first heat exchanger 158 and the expansion valve 168 via the second flow path 254 (e.g., to force the refrigerant to flow from the first heat exchanger 158 to the expansion valve 168 via the first flow path 252 in the cooling mode).

For instance, the on/off valve 258 may be a solenoid valve that may transition between the open position and the closed position based on a signal received from the control system 184. In some embodiments, the signal may actuate the on/off valve 258 to adjust the on/off valve 258 to the closed position, and the on/off valve 258 may be configured to be in the open position when the signal is not received. In alternative embodiments, the signal may actuate the on/off valve 258 to adjust the on/off valve 258 to the open position, and the on/off valve 258 may be configured to be in the closed position when the signal is not received.

Additional or alternative embodiments of the heat pump system 150 may include other suitable components to control the flow of refrigerant through the refrigerant circuit 152 in the various operating modes. For example, the valves 164, 166 may be configured to enable refrigerant flow through both the first line 159 and the reheat line 163, the flow paths 252, 254 may include different valves, the drain lines 176, 178 may not be incorporated, additional or alternative drain lines may be incorporated, alternative valves may be used (e.g., an on/off valve instead of the check valve 169 to block refrigerant flow into the reheat line 163), and so forth.

The present disclosure may provide one or more technical effects useful in the operation of an HVAC system. For example, the HVAC system may include a heat pump system configured to operate a refrigerant circuit in a cooling mode, a heating mode, and/or a reheat mode. In the heating mode, a reversing valve may direct pressurized refrigerant to a first heat exchanger, such as an indoor heat exchanger, to heat a supply air flow. In the cooling mode, the reversing valve of the heat pump system may direct pressurized refrigerant to a valve, which is positioned to direct the pressurized refrigerant to a second heat exchanger, such as an outdoor heat exchanger, for cooling the pressurized refrigerant before directing the cooled refrigerant to the first heat exchanger to cool the supply air flow. In the reheat mode, the reversing valve may direct pressurized refrigerant to the valve, which directs the pressurized refrigerant to a reheat heat exchanger, instead of to the second heat exchanger. The refrigerant circuit may then direct the refrigerant from the reheat heat exchanger to the first heat exchanger. The first heat exchanger may cool the supply air flow and remove an amount of moisture contained within the supply air flow, and the reheat heat exchanger may heat (e.g., reheat) the cooled, dehumidified supply air flow to a higher temperature. In this manner, the heat pump system may be configured to operate in different manners to enable improved conditioning of a space serviced by the heat pump system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat pump system, comprising:

a refrigerant circuit comprising a compressor, a reversing valve, a first heat exchanger, a second heat exchanger, a reheat heat exchanger, a first three-way valve, and a second three-way valve, wherein the reversing valve is configured to receive refrigerant from the compressor and adjust between a first configuration to direct the refrigerant toward the first three-way valve and a second configuration to direct the refrigerant toward the first heat exchanger, wherein the first three-way valve is configured to adjust between a first position to direct the refrigerant between the reversing valve and the second heat exchanger and a second position to direct the refrigerant from the reversing valve to the reheat heat exchanger, and wherein the second three-way valve is configured to adjust between a third position to direct the refrigerant between the first heat exchanger and the second heat exchanger and a fourth position to block flow of the refrigerant between the first heat exchanger and the second heat exchanger.

2. The heat pump system of claim 1, wherein the first three-way valve is configured to block flow of the refrigerant from the reversing valve to the reheat heat exchanger in the first position, and the first three-way valve is configured to block flow of the refrigerant between the reversing valve and the second heat exchanger in the second position.

3. The heat pump system of claim 1, comprising a control system configured to:

position the reversing valve in the second configuration and position the first three-way valve in the first position to operate the heat pump system in a heating mode;

position the reversing valve in the first configuration and position the first three-way valve in the first position to operate the heat pump system in a cooling mode; and position the reversing valve in the first configuration and position the first three-way valve in the second position to operate the heat pump system in a reheat mode.

4. The heat pump system of claim 1, wherein the first heat exchanger is an indoor heat exchanger, and the second heat exchanger is an outdoor heat exchanger.

5. The heat pump system of claim 1, wherein the second three-way valve is configured to direct the refrigerant from the reheat heat exchanger to the first heat exchanger in the fourth position and to block flow of the refrigerant between the reheat heat exchanger and the first heat exchanger in the third position.

6. The heat pump system of claim 1, wherein the refrigerant circuit comprises a check valve configured to block flow of the refrigerant from the first heat exchanger to the reheat heat exchanger.

7. A tangible, non-transitory, computer-readable medium comprising instructions, wherein the instructions, when executed by processing circuitry, are configured to cause the processing circuitry to:

position a reversing valve of a heat pump system in a first configuration to direct flow of refrigerant from the reversing valve toward a first three-way valve of the heat pump system and position the first three-way valve in a first position to direct flow of the refrigerant from the first three-way valve to an outdoor heat exchanger of the heat pump system in a cooling mode of the heat pump system;

position the reversing valve in the first configuration to direct flow of the refrigerant from the reversing valve toward the first three-way valve and position the first three-way valve in a second position to direct flow of the refrigerant from the first three-way valve to a reheat heat exchanger of the heat pump system in a reheat mode of the heat pump system;

position the reversing valve in a second configuration to direct flow of the refrigerant from the reversing valve toward an indoor heat exchanger of the heat pump system in a heating mode of the heat pump system;

position a second three-way valve of the heat pump system in a third position in the heating mode and in the cooling mode of the heat pump system to enable flow of the refrigerant between the indoor heat exchanger and the outdoor heat exchanger; and position the second three-way valve in a fourth position in the reheat mode of the heat pump system to block flow of the refrigerant between the indoor heat exchanger and the outdoor heat exchanger.

8. The tangible, non-transitory, computer-readable medium of claim 7, wherein the instructions, when executed by the processing circuitry, are configured to cause the processing circuitry to position the first three-way valve in the first position to direct flow of the refrigerant from the outdoor heat exchanger to the reversing valve via the first three-way valve in the heating mode of the heat pump system.

9. The tangible, non-transitory, computer-readable medium of claim 7, wherein the instructions, when executed by the processing circuitry, are configured to cause the processing circuitry to position the first three-way valve in the second position to block flow of the refrigerant from the first three-way valve to the outdoor heat exchanger in the reheat mode.

10. The tangible, non-transitory, computer-readable medium of claim 7, wherein the instructions, when executed by the processing circuitry, are configured to cause the processing circuitry to operate a fan in the cooling mode to direct an air flow across the outdoor heat exchanger to maintain flow of the refrigerant from the outdoor heat exchanger toward the indoor heat exchanger above a threshold flow rate.

11. The tangible, non-transitory, computer-readable medium of claim 10, wherein the instructions, when executed by the processing circuitry, are configured to cause the processing circuitry to operate the fan based on a pressure of the refrigerant, a temperature of the refrigerant, a detected flow rate of the refrigerant, a temperature of outdoor air, or any combination thereof.

12. The tangible, non-transitory, computer-readable medium of claim 7, wherein the instructions, when executed by the processing circuitry, are configured to cause the processing circuitry to:

operate a fan in the cooling mode and in the heating mode to direct an air flow across the outdoor heat exchanger; and suspend operation of the fan in the reheat mode.

13. A heat pump system, comprising:

a refrigerant circuit comprising a compressor, a reversing valve, a first heat exchanger, a second heat exchanger, a reheat heat exchanger, a three-way valve, and a first flow path and a second flow path arranged in parallel with one another and extending between the second heat exchanger and the first heat exchanger, wherein the reversing valve is configured to receive refrigerant from the compressor and adjust between a first configuration to direct the refrigerant toward the three-way valve and a second configuration to direct the refrigerant toward the first heat exchanger, wherein the three-way valve is configured to adjust between a first position to direct the refrigerant between the reversing valve and the second heat exchanger and a second position to direct the refrigerant from the reversing valve to the reheat heat exchanger, and wherein the first flow path comprises a check valve configured to enable flow of the refrigerant from the second heat exchanger toward the first heat exchanger, and the second flow path comprises a solenoid valve configured to adjust between a third position to direct the refrigerant between the first heat exchanger and the second heat exchanger and a fourth position to block flow of the refrigerant between the first heat exchanger and the second heat exchanger.

14. The heat pump system of claim 13, comprising a control system communicatively coupled to the solenoid valve, wherein the control system is configured to cause the solenoid valve to:

adjust to the third position in a heating mode of the heat pump system;

adjust to the fourth position in a cooling mode of the heat pump system, and adjust to the fourth position in a reheat mode of the heat pump system.

15. The heat pump system of claim 14, wherein the third position is an open position, and the fourth position is a closed position.

* * * * *